United States Patent [19]

Moore

[11] Patent Number: 4,709,890

[45] Date of Patent: Dec. 1, 1987

[54] LANTERN HOLDER

[76] Inventor: Carl F. Moore, 4417 Mellowood Cir., Knoxville, Tenn. 37920

[21] Appl. No.: 904,209

[22] Filed: Sep. 8, 1986

[51] Int. Cl.[4] ..... A47B 96/00

[52] U.S. Cl. ..... 248/205.1; 248/231.7; 248/301; 362/396; 403/213

[58] Field of Search ..... 248/205.1, 231.7, 301, 248/304, 309.1, 225.31, 310; 403/213, 209; 262/413; 362/396

[56] References Cited

U.S. PATENT DOCUMENTS

| | | | |
|---|---|---|---|
| 680,680 | 8/1901 | Armstrong et al. | 248/231.7 |
| 841,550 | 1/1907 | Leonard | 248/301 X |
| 1,679,715 | 8/1928 | Fish | 248/225.31 |
| 3,535,508 | 10/1970 | Warshauser | 248/231.7 X |
| 3,652,049 | 3/1972 | McCown | 248/310 |
| 3,843,082 | 10/1974 | Garret | 248/309.1 X |
| 3,844,519 | 10/1974 | Garrett | 248/225.31 |
| 3,902,931 | 9/1975 | Danciger et al. | 248/231.7 |
| 4,039,136 | 8/1977 | DeHart | 248/301 X |
| 4,661,895 | 4/1987 | Hull | 362/396 X |

*Primary Examiner*—Ramon O. Ramirez
*Attorney, Agent, or Firm*—Pitts and Brittian

[57] ABSTRACT

A lantern holder (10) for releasably supporting a lantern (14), and for being releasably mounted on a boat cleat (12). The lantern holder (10) comprises an elongated support arm (32) defining a first end portion (34) and a further distal end portion (36), the support arm (32) being provided at the distal end portion (36) with means for releasably engaging and supporting a lantern (14). The lantern holder (10) further comprises a cleat engaging means (42) mounted at the first end portion (34). In the preferred embodiment of the lantern holder (10), the cleat engaging means (42) comprises at least one shank portion (44) for being received under, and releasably engaging the upper portion of a cleat (16), the shank portion defining a first end portion, (48) secured to the first end portion (34) of the support arm (32) and a second end portion (50) provided with retaining means (51) for engaging the upper portion (24) of the cleat (16) whereby the shank portion (44) is releasably held in position beneath the upper portion (24) of the cleat (16).

20 Claims, 6 Drawing Figures

LANTERN HOLDER

DESCRIPTION

TECHNICAL FIELD

This invention relates to a lantern holder which can be releasably mounted on a conventional boat cleat for releasably supporting a lantern. In this particular invention, the lantern holder comprises a support arm having a first end portion provided with cleat engaging means and a further distal end portion provided with means for releasably engaging a lantern.

BACKGROUND ART

Fishermen and boaters have often found it desirable to mount lanterns, such as gasoline or kerosene fueled lanterns, on their boats to provide illumination at night. Since most boats do not provide holding means for mounting lanterns, various devices have been devised which are designed to be mounted on a boat for holding a lantern. For example, the following patents disclose various lantern holding devices:

| PATENT | ISSUED TO | DATE |
|---|---|---|
| 2,867,403 | F. J. Graf | January 6,1959 |
| 3,652,049 | McCowan | March 28, 1972 |
| 3,844,519 | Garrett | October 29,1974 |
| 3,998,418 | Boulanger | December 21,1976 |

It will be noted that whereas the devices of the above referenced patents provide structures for releasably supporting lanterns, such devices incorporate various complicated clamping and fastening means, and are otherwise unnecessarily complex. Moreover, the devices which make use of structures commonly found on at least some boats, such as oar locks and hand rails, for mounting do not provide for the mounting of the lantern a preselected distance from the boat to decease the chance of fire originating with the lantern being spread to the boat.

Therefore, the object of the present invention is to provide a lantern holder for releasably supporting a lantern.

Another object of the present invention is to provide a lantern holder which engages and is supported by a boat cleat.

Still another object of the present invention is to provide a lantern holder which supports a lantern at a preselected distance from the boat or structure on which the holder is mounted to reduce the risk of fire.

Yet another object of the present invention is to provide a lantern holder which is inexpensive to manufacture and maintain.

DISCLOSURE OF THE INVENTION

Other objects and advantages will be accomplished by the present invention which provides a lantern holder for releasably mounting a lantern on a boat, boat dock or other supporting structure. The lantern holder is designed to be secured to a conventional boat cleat provided on the boat or other supporting structure, the cleat comprising a base portion for mounting the cleat, an upper portion defining a pair of oppositely disposed projecting arms, and a waist portion joining the base portion and upper portions of the cleat. The lantern holder comprises an elongated support arm defining a first end portion and a further distal end portion, the distal end portion being provided with means for releasably engaging and supporting a lantern. The lantern holder further comprises cleat engaging means mounted proximate the first end portion of the support arm for releasably engaging the cleat, the cleat engaging means comprising a shank portion for being received under and releasably engaging the upper portion of the cleat. The shank portion defines a first end portion secured to the first end portion of the support arm and at least one second end portion provided with retainer means for engaging the upper portion of the cleat, whereby the shank portion of the cleat engaging means is releasably held in position beneath the upper portion of the cleat.

BRIEF DESCRIPTION OF THE DRAWINGS

The above-mentioned features of the invention will become more clearly understood from the following detailed description of the invention read together with the drawings in which.

BEST MODE FOR CARRYING OUT THE INVENTION

Figure 1:
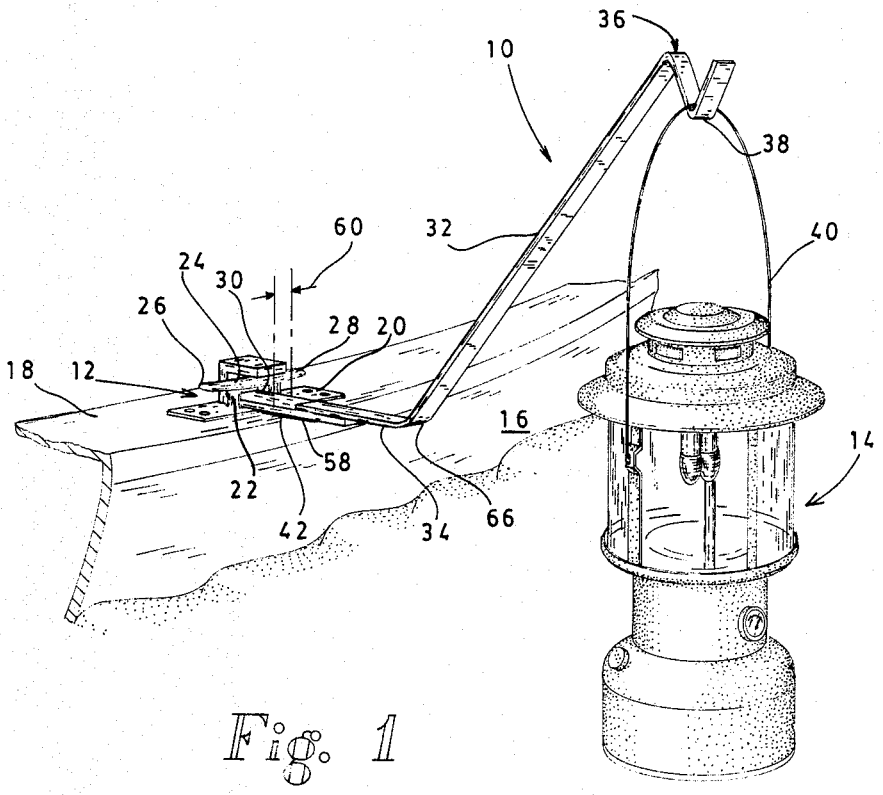
FIG. 1 illustrates a perspective view of the lantern holder of the present invention depicting the lantern holder secured to a boat cleat and supporting a lantern.

A lantern holder incorporating various features of the present invention is illustrated generally at 10 in the figures. As illustrated in FIG. 1, the lantern holder 10 is designed to be releasably secured to a boat cleat 12 and to hold a lantern 14 in a preselected position displaced from the cleat 12. In FIG. 1, the holder 10 has been releasably secured to a cleat 12 which is mounted on the gunwale of a boat 16 such that the lantern is held out over the water at a safe distance from the boat. However, it will be appreciated that the cleats 12 are commonly mounted on boat docks and other supporting structures and that use of the lantern holder 10 is not limited to the releasable mounting of a lantern 14 on a boat.

A conventional boat cleat such as the illustrated cleat 12 comprises a base portion 20 for securing the cleat 12 to the supporting surface 18 of the boat 16 or other supporting structure. Extending upward from the base portion 20 is a waist portion 22 which carries an upper portion 24, the upper portion 24 defining oppositely disposed arms 26 and 28 which extend beyond the waist portion 22. Further, the waist portion 22 defines an opening 30 therethrough. It will be appreciated by those skilled in the art that cleats such as the cleat 12 are configured to facilitate the securing of ropes or line. However, as will become clear from the discussion which follows, the lantern holder 10 utilizes the cleat 12, as configured, as a securing structure thereby obviating the need for providing a specially designed securing structure for mounting the holder 10 on the boat 16.

The lantern holder 10 generally comprises an elongated support arm 32 defining a first end portion 34 and a further distal end portion 36, the distal end portion 36 being provided with means for releasably engaging and supporting the lantern 14. In the preferred embodiment of the holder 10, the means for releasably engaging and supporting the lantern 14 comprises a hook portion 38 which is receptive of the handle 40 of the lantern 14. Of course, it will be appreciated that other means of releasably securing the lantern 14 to the distal end portion 36 of the support arm 32 can be utilized and the hook portion 38 is simply one preferred means.

The lantern holder 10 further comprises the cleat engaging means 42 carried by the first end portion 34 of the support arm 32 for releasably engaging the cleat 12 to effect the mounting of the holder 10 on the boat 16. In the preferred embodiment, the cleat engaging means 42 comprises a shank portion 44 defining a lower surface 46, and having a first end portion 48 secured to the first end portion 34 of the support arm 32. It should be noted that whereas the illustrated embodiment depicts the shank portion 44 as being welded to the support arm 32, it will be appreciated that other securing means can be used to secure the shank portion 44 to the support arm 32 or the shank portion 44 can be integral with the arm 32. The shank portion 44 also defines a second end portion 50 which carries the retainer means 51. In the preferred embodiment, the retainer means 51 comprises an upturned brace member 52, the brace member 52 in turn carrying a further brace member 54 at its upper end portion such that a hook-shaped retaining member is defined at the second end portion 50 of the shank portion 44.

Figure 3:
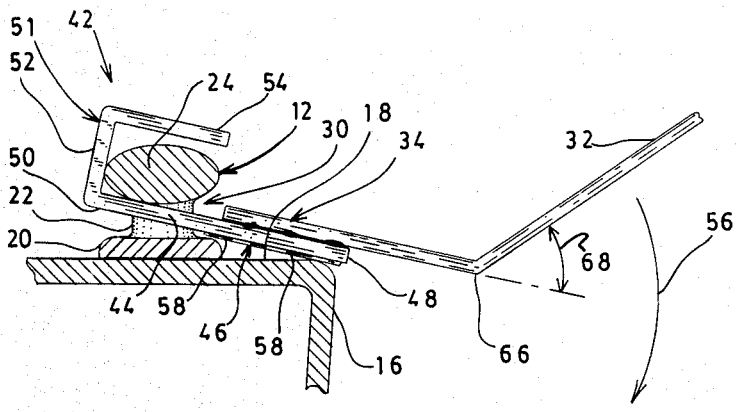
FIG. 3 is a side elevation view of the cleat engaging means of the lantern holder of the present invention as such means engages a boat cleat.

Referring now to FIG. 3, the mounting of the lantern holder 10 on the cleat 12 is accomplished by inserting the further brace member 54, the brace member 52, and a selected portion of the shank portion 44 of the cleat engaging means 42, through the opening 30 in the cleat 12. As illustrated by the arrow 56, the weight of the support arm 32, and the weight of the lantern 14 when mounted, biases the shank portion 44 toward the supporting surface 18 such that the lower surface 46 of the shank portion 44 engages the supporting surface 18 and/or the base portion 20 of the cleat 12. Resultantly, the second end portion 50 of the shank portion 44 is pivotally biased in an upward direction to engage the upper portion 22 of the cleat 12, with the retainer means 51, and more specifically the upwardly disposed brace member 52, serving to hold the shank portion 44 in position in the opening 30.

It will also be noted that in the preferred embodiment, the lower surface 46 of the shank portion 44 defines a planar surface having a sufficient width (such width being depicted at 60 in FIG. 1) to resist lateral pivoting of the holder 10 as the cleat engaging means 42 is seated in the cleat 12. Further, in the preferred embodiment of the holder 10, the lower surface 46 of the shank portion 44, or a substantial portion thereof, is covered with a cushion member 58 fabricated of rubber or other soft resilient material to ensure that the cleat engaging means 42 does not mar the supporting surface 18 or the base portion 20 of the cleat 12. Also, it will also be appreciated that a cushion member 58 fabricated of rubber or similar material tends to grip the surface 18 and/or the base portion 20, thereby facilitating the stationary mounting of the lantern holder 10.

Figure 4A:
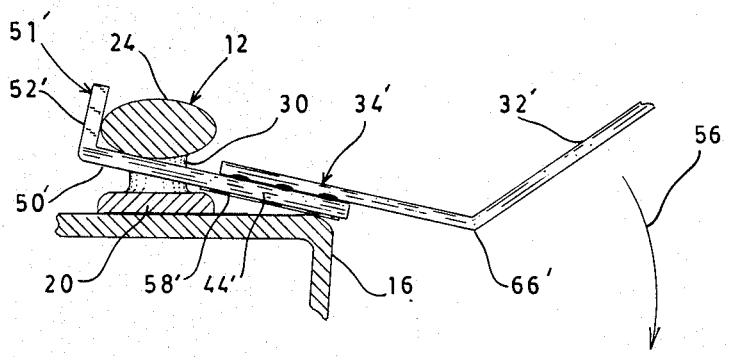
FIG. 4A illustrates a side elevation view of an alternate embodiment of the cleat engaging means of the lantern holder of the present invention.
Figure 4B:
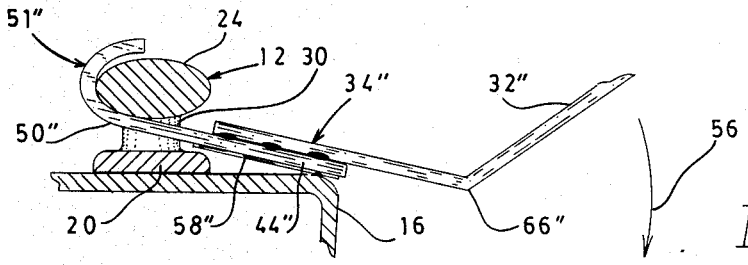
FIG. 4B illustrates a side elevation view of an alternate embodiment of the cleat engaging means of the lantern holder of the present invention.

In FIGS. 4A and 4B, certain alternative retainer means are illustrated at 51' and 51'', respectively. As illustrated, the retainer means 51' comprises an upturned brace member 52', but, unlike the retainer means 51, is not provided with a further brace member 54. It will be appreciated by those skilled in the art that, notwithstanding the absence of the further brace member 54, the retainer means 51' will serve to hold the shank portion 44' in position in the cleat 12. The retainer means 51'', illustrated in FIG. 4B, comprises a hook-shaped member which also serves as a suitable means for retaining the shank portion 44'' in position in the cleat 12.

Figure 5:
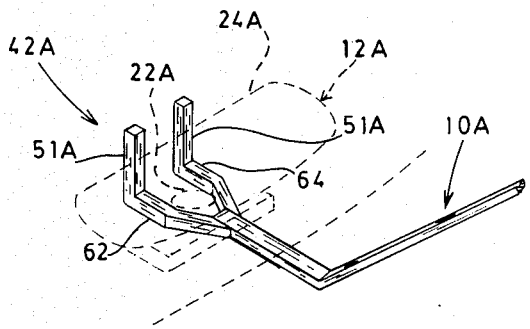
FIG. 5 illustrates a perspective view of an alternate embodiment of the cleat engaging means of the lantern holder of the present invention.

FIG. 5 illustrates an alternative cleat engaging means 42A. In this regard, it will be recognized by those skilled in the art that certain conventional boat cleats, such as the illustrated cleat 12A are not provided with the opening 30 of the cleat 12. Accordingly, in the alternative cleat engaging means 42A, a pair of shank portions 62 and 64 are defined which are each provided with retainer means 51A. (The retainer means 51A being in accordance with the retainer means 51, 51', or 51''). As illustrated, when the holder 10A is mounted in the cleat 12A, the shank portions 62 and 64 are disposed on opposite sides of the waist portion 22A and function, as does the shank portion 44, to supportively engage the upper portion 24A of the cleat 12A.

Figure 2:
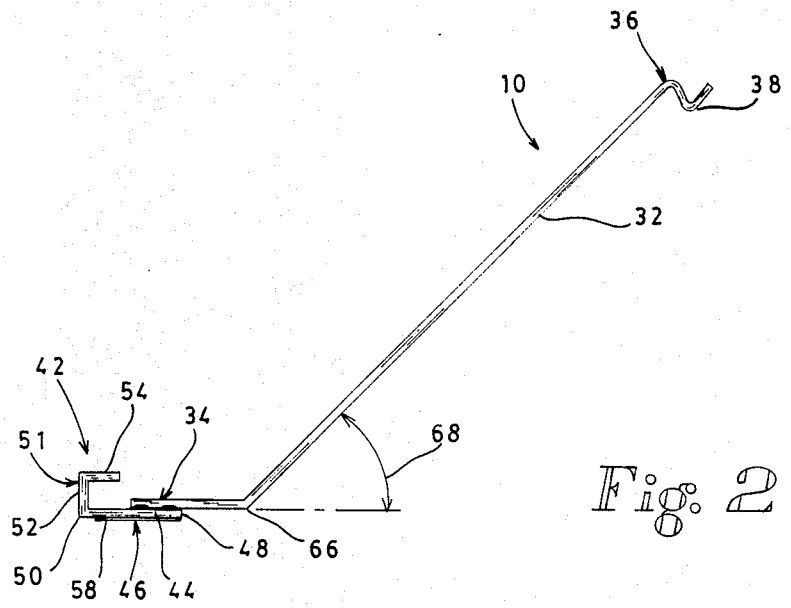
FIG. 2 is a side elevation view of the lantern holder of the present invention.

As is best illustrated in FIG. 2, in the preferred embodiment of the lantern holder 10, the elongated support arm 32 defines a bend 66 such that as the cleat engaging means 42 is secured in the cleat 12, the support arm 32 is upwardly disposed at a preselected angle 68 (see FIGS. 2 and 3). This upward disposition of the support arm 32 at the preselected angle 68 serves to elevate the position of the lantern 14 to better utilize the illumination provided, while at the same time displaces the lantern 14 a preselected distance from the side of the boat 16 to allow the lantern 14 to be operated without the risk of fire being communicated to the boat. In this regard, it has been found that for most applications, the desired elevation and displacement of the lantern 14 can best be achieved where the angle 68 defines an angle of 40 to 50 degrees. However, depending on the support structure on which the lantern holder 10 is to be mounted, and the area to be illuminated, other angles may be desirable.

Thus, it will be appreciated that the present invention provides a lantern holder which can be releasably mounted on a conventional boat cleat for releasably holding a lantern. Accordingly, the holder 10 requires no special mounting brackets and no special clamps. Moreover, the holder 10 allows the lantern to be mounted at an elevated position displaced from the side of the boat or other support structure in order to enhance illumination and at the same time reduce the risk of fire.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. A lantern holder for releasably supporting a lantern and for releasably engaging and being supported by a cleat mounted on a supporting surface, said cleat comprising a base portion for mounting said cleat on said supporting surface, an upper portion defining a pair of oppositely disposed horizontally projecting arms, and a bottom surface and a rear side surface oppositely disposed from a side surface toward said lantern, and a waist portion joining said base portion and said upper portion, said lantern holder comprising:

an elongated support arm defining a first end portion and a further distal end portion, said distal end portion being provided with means for releasably engaging and supporting said lantern; and cleat engaging means fixedly carried by said first end portion of said support arm for releasably engaging said cleat, said cleat engaging means comprising at least one shank portion having a lower surface for being received under and releasably engaging said bottom surface of said upper portion of said cleat, said shank portion defining a first end portion extending from said first end portion of said support arm and a second end portion provided with an upstanding retainer means for engaging said rear side surface of said upper portion of said cleat whereby weight of said lantern engaged with said distal end portion of said support arm causes said support arm to be biased downwardly such that said lower surface of said shank portion contacts said supporting surface and said shank portion and said retainer means are releasably engaged with said upper portion of said cleat.

2. The lantern holder of claim 1 wherein said retainer means of said cleat engaging means comprises an upturned brace member carried by said second end portion of said shank portion whereby said upturned brace member releasably engages said rear side surface of said upper portion of said cleat for holding said shank portion in position beneath said upper portion of said cleat.

3. The lantern holder of claim 2 wherein said upturned brace member defines an upper end portion and said retainer means further comprises a further brace member carried by said upper end portion of said upturned brace member, said further brace member being disposed substantially perpendicular to said upturned brace member whereby said shank portion, said upturned brace member, and said further brace member define a substantially hook-shaped retainer member to substantially embrace said upper portion of said cleat.

4. The lantern holder of claim 1 wherein said retainer means of said cleat engaging means comprises an arcuate hook shaped member for engaging said upper portion of said cleat, whereby said shank portion is releasably held in position beneath said upper portion of said cleat.

5. The lantern holder of claim 1 wherein said cleat engaging means comprises a pair of said shank portions, each of said shank portions having a first end carried by said first end of said support arm, and a second end provided with said retainer means, for being releasably received on opposite sides of said waist portion of said cleat and for being received under and engaging said upper portion of said cleat.

6. The lantern holder of claim 5 wherein said retainer means of said cleat engaging means carried by each said shank portion comprises an upturned brace member carried by said second end portion of said shank portion whereby said upturned brace member releasably engages said rear side surface of said upper portion of said cleat for holding said shank portions in position beneath said upper portion of said cleat.

7. The lantern holder of claim 6 wherein each said upturned brace member defines an upper end portion and each said retainer means further comprises a further brace member carried by said upper end portion of said upturned brace member, each said further brace member being disposed substantially perpendicular to each said upturned brace member whereby said shank portions, said upturned brace members, and said further brace members define substantially hook-shaped retainer members.

8. The lantern holder of claim 5 wherein said retainer means of each said shank portion comprises an arcuate hook shaped member for engaging said upper portion of said cleat, whereby each said shank portion is releasably held in position beneath said upper portion of said cleat.

9. The lantern holder of claim 1 wherein said shank portion defines a lower surface for releasably engaging said supporting surface for facilitating the stable positioning of said lantern holder as said cleat engaging means engages said cleat.

10. The lantern holder of claim 1 wherein said lower surface of said shank portion is provided with a cushion member for preventing damage to said supporting surface.

11. The lantern holder of claim 1 wherein said means for releasably engaging and supporting said lantern comprises a hook portion proximate said distal end of said support arm.

12. The lantern holder of claim 1 wherein said support arm defines a bend proximate said first end portion defining a preselected angle whereby said distal end of said support arm is elevated relative to said first end portion of said support arm as said cleat engaging means releasably engages said cleat.

13. The lantern holder of claim 1 wherein said cleat engaging means is integrally formed with said support arm.

14. A lantern holder for releasably supporting a lantern, said lantern being provided with a handle, and for releasably engaging and being supported by a cleat mounted on a supporting surface, said cleat comprising a base portion for mounting said cleat on said supporting surface, and upper portion defining a pair of oppositely disposed horizontally projecting arms a bottom surface and a rear side surface, and a waist portion joining said base portion and said upper portion, said waist portion defining an opening therethrough, said lantern holder comprising:

an elongated support arm defining a first end portion and a further distal end portion, said distal end portion being provided with means for releasably engaging and supporting said lantern, said means for releasably engaging and supporting said lantern comprising a hook portion for receiving said handle of said lantern; and cleat engaging means fixedly carried by said first end portion of said support arm for releasably engaging said cleat, said cleat engaging means comprising a shank portion, said shank portion defining a first end portion extending from said first end portion of said support arm and a second end portion provided with retainer means for being inserted through said opening in said waist portion of said cleat whereby said shank portion releasably engages said lower surface of said upper portion of said cleat.

15. The lantern holder of claim 14 wherein said retainer means of said cleat engaging means comprises an upturned brace member carried by said second end portion of said shank portion whereby said upturned brace member releasably engages said rear side surface of upper portion of said cleat for holding said shank portion in position in said opening of said waist portion of said cleat.

16. The lantern holder of claim 15 wherein said upturned brace member defines an upper end portion and said retainer means further comprises a further brace member carried by said upper end portion of said upturned brace member, said further brace member being disposed substantially perpendicular to said upturned brace member whereby said shank portion, said upturned brace member, and said further brace member define a substantially hook-shaped cleat engaging means.

17. The lantern holder of claim 14 wherein said retainer means of said cleat engaging means comprises an arcuate hook shaped member for being received through said opening of said waist portion and engaging said upper portion of said cleat.

18. The lantern holder of claim 14 wherein said shank portion defines a lower surface for releasably engaging said supporting surface for facilitating the stable positioning of said lantern holder as said cleat engaging means engages said cleat.

19. The lantern holder of claim 14 wherein said support arm defines a bend proximate said first end portion defining a preselected angle whereby said distal end of said support arm is elevated relative to said first end portion of said support arm as said cleat engaging means releasably engages said cleat.

20. A lantern holder for releasably supporting a lantern and for releasably engaging and being supported by a cleat mounted on a supporting surface, said cleat comprising a base portion for mounting said cleat on said supporting surface, an upper portion defining a pair of oppositely disposed horizontally projecting arms and a bottom surface and a rear side surface oppositely disposed from a side surface toward said lantern, and a waist portion joining said base portion and said upper portion, said lantern holder comprising:

an elongated support arm defining a first end portion and a further distal end portion, said distal end portion being provided with means for releasably engaging and supporting said lantern; and cleat engaging means fixedly carried by said first end portion of said support arm for releasably engaging said cleat, said cleat engaging means comprising a pair of shank portions for being received on opposite sides of said waist portion of said cleat, each said shank portion having a lower surface and defining a first end portion extending from said first end of said support arm and a second end portion provided with upstanding retainer means for engaging said rear side surface of said upper portion of said cleat whereby weight of said lantern engaged with said distal end portion of said support arm biases said support arm downwardly such that said lower surface of each of said shank members contacts said supporting surface and said shank portions and said retainer means are releasably engaged with said upper portion of said cleat.

* * * * *